United States Patent [19]

Nakajima et al.

[11] 4,099,786

[45] Jul. 11, 1978

[54] APPARATUS FOR DRAWING THE SHEARERS

[75] Inventors: Shigeo Nakajima, Tokyo; Hajime Endo, Kushiro, both of Japan

[73] Assignee: Taiheiyo Engineering Incorporated, Tokyo, Japan

[21] Appl. No.: 775,141

[22] Filed: Mar. 7, 1977

[30] Foreign Application Priority Data

Aug. 31, 1976 [JP] Japan ..... 51-116857[U]

[51] Int. Cl.[2] ..... E21C 27/34

[52] U.S. Cl. ..... 299/43; 299/50

[58] Field of Search ..... 299/32, 34, 43, 50

[56] References Cited

U.S. PATENT DOCUMENTS 3,409,329 11/1968 Dommann et al. ..... 299/34

3,753,596 8/1973 Pentith ..... 299/43

4,006,937 2/1977 Curtis ..... 299/43

*Primary Examiner*—Ernest R. Purser

*Attorney, Agent, or Firm*—Frank J. Jordan

[57] ABSTRACT

Apparatus for drawing shearers comprises a conveyor on which the shearers move with sledges interposed therebetween and which is arranged along a long-walled pit face of a coal mine shearers drawing cable is arranged in fixing members which are arranged on the conveyor, and a pair of means are provided for releasing and fixing the cable from and into the fixing members, the means being arranged adjacent to the sledges and the cable located between the cable releasing and fixing means being engaged with a cable driving means housed in each of the shearer bodies, wherein a drawing force is applied only to the cable located between the cable releasing and fixing means when the driving means is rendered operative.

10 Claims, 4 Drawing Figures

APPARATUS FOR DRAWING THE SHEARERS

The present invention relates to an improvement of apparatus for drawing the ranging drum of shearers which are coal mining machines employed at a long-walled pit face of a coal mine.

In case of the conventional shearers each provided with a means for drawing the shearer by a cable, both ends of the shearer drawing cable are secured to both ends of a conveyor arranged along the long-walled pit face, namely, adjacent to both side ends of the pit face by means of fixing members. And the movement of the shearer is attained in such a manner that a sprocket wheel attached to the shearer drawing means and having driving force draws the cable.

This conventional way for causing the shearer to be moved forces the cable to be made longer as the length from one side end to the other of the pit face becomes longer, so that the length of the cable to be tensioned at the time when the shearer is drawn becomes much longer to give rise to the surging phenomenon of the shearer as well as to make the life of the cable short.

Further, in this conventional way in which, for example, two shearers are employed at a pit face using a common cable, it is necessary to make the cable two times stronger than before because the shearer drawing means of one shearer is affected by the tension which is applied to the cable by the other shearer. In addition, when both of the shearers are operated at the same time, they interfere with each other to cause the productivity to be lowered.

It is, therefore, a primary object of the present invention to provide an apparatus for drawing the shearers and which is capable of eliminating the above-mentioned drawbacks and making the distance, between which the cable is secured, as short as possible to shorten the length of the cable which is to be tensioned at the time when a drawing force is applied to the cable.

Another object of the present invention is to provide an apparatus for drawing the shearers which enables plural shearers to be operated at same time using a cable of the same strength as that of the one which is to be used when one shearer is employed, and to be left unaffected with one another.

A further object of the present invention is to provide an apparatus for drawing the shearers which allows the shearers provided with the shearer drawing apparatus of the present invention to be exchanged with the ones even at a pit face where the length from one side end to the other of the pit face is short enough to disregard the length of the cable which is to be tensioned at the time that a drawing force is applied to the cable.

These and other objects as well as the merits of the present invention will be apparent from the following detailed description with reference to the accompanying drawings.

FIGS. 1 through 4 show an embodiment of the present invention which is applied to a ranging drum shearer having two shearing drums provided at one end of the front face thereof.

Figure 1:
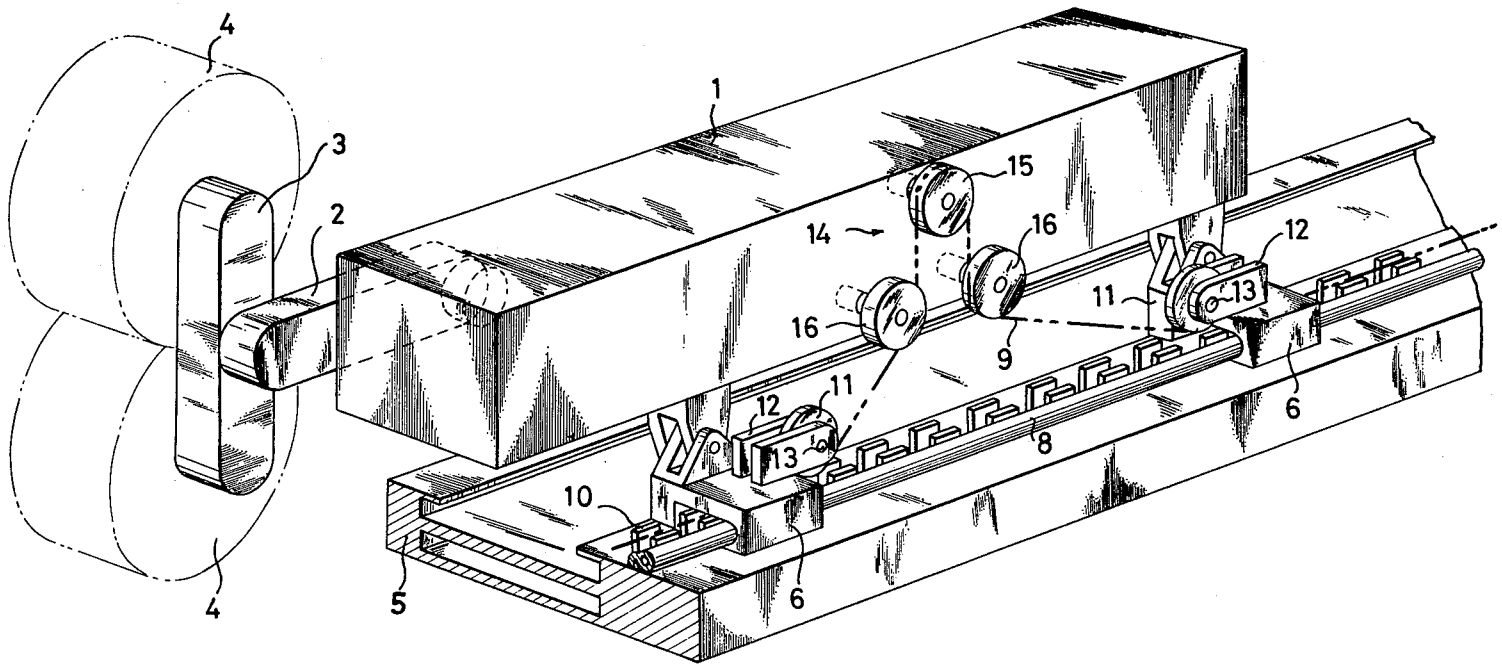
FIG. 1 is an isometric view showing an embodiment of the present invention which is applied to a ranging drum shearer.
Figure 2:
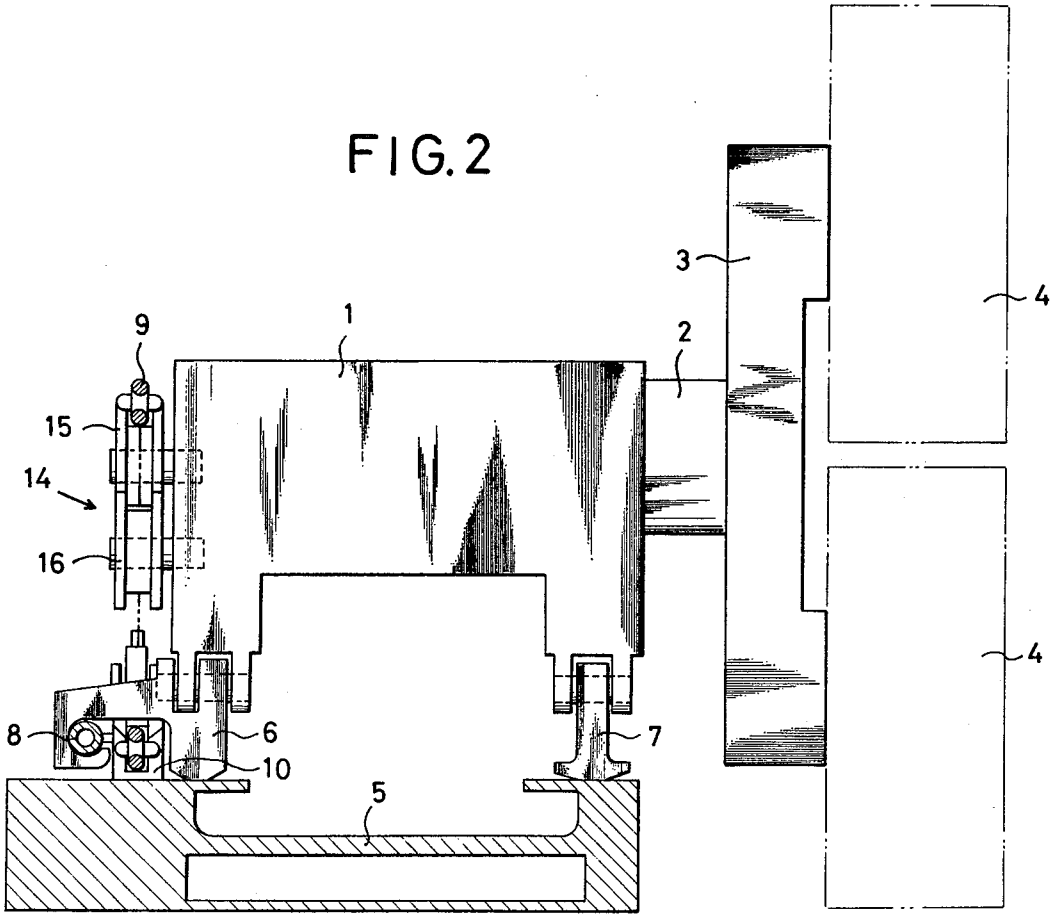
FIG. 2 is a side view of the embodiment shown in FIG. 1.
Figure 3:
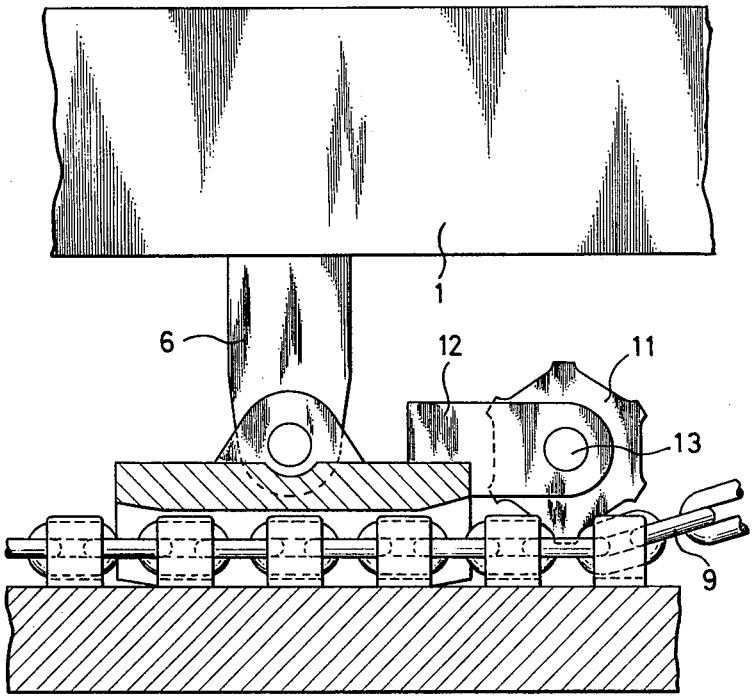
FIG. 3 is an enlarged front view showing main components of the embodiment.
Figure 4:
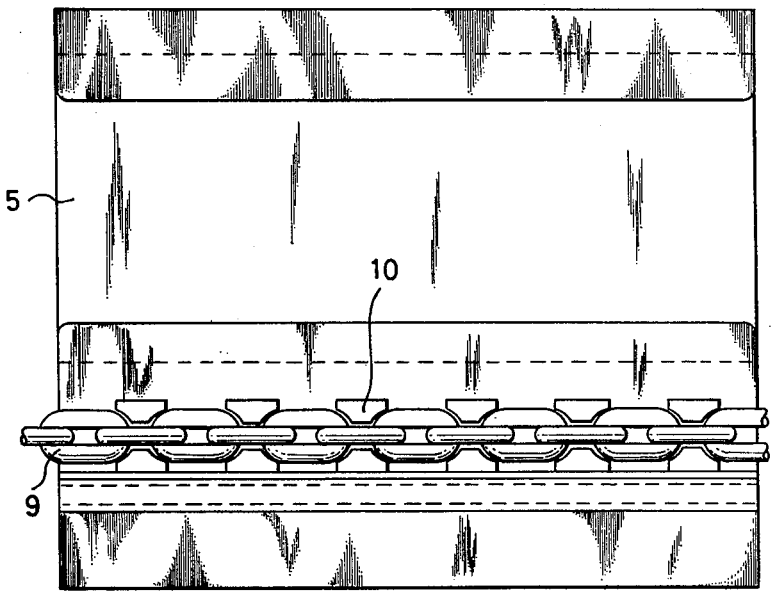
FIG. 4 is an enlarged plan view showing main components of the embodiment shown in FIG. 3.

In the FIGS. numeral 1 represents a shearer body which houses therein a driving means for driving shearing drums 4 and 4 attached to the shearer body 1 through a main ranging arm 2 and a sub-ranging arm 3. The shearer body 1 is mounted through sledges 6 and 7 on a conveyor 5 arranged along the pit face, as shown in FIG. 2, and is guided by a guide 8 to reciprocate on the conveyor 5 along the pit face. Each of the sledges 6 arranged at the side opposite to the pit face is provided with a projection projecting to the side opposite to the pit face to bridge a cable 9 and members 10 for fixing the cable 9 and to hold the guide 8 in its recessed portion. The cable 9 may be a chain or the like having concavo-convex portions or holes alternately. Numeral 11 represents guide wheels for guiding the cable 9, each of the guide wheels 11 being loosely attached by means of a pin 13 to a bearing member 12 attached on each of the sledges 6. The cable fixing members 10 are projections aligned on the conveyor 5 in a form of the teeth of a saw and having concavities corresponding to the shape of the cable 9. The cable 9 is fixed by the cable fixing members 10 in such a manner that the cable 9 is fitted into the concavities of the fixing member 10. As shown in FIGS. 3 and 4, the cable 9 is usually fitted into the concavities of the cable fixing member 10.

Numeral 14 denotes a driving section arranged at the side of the shearer body 1 opposite to the pit face and comprising the driving means housed in the shearer body 1, a wheel 15 driven by the driving means, and guide wheels 16 and 16 for guiding the cable 9 to the wheel 15.

For the purpose of moving the shearer on the conveyor, the driving means housed in the shearer body 1 is rendered operative to drive the wheel 15 of the driving section 14. In this case, corresponding to the direction in which the shearer is to be moved, the direction in which the wheel 15 is rotated is determined by a changeover means. When the wheel 15 is rotated, the cable 9 guided by the guide wheels 16 and 16 and engaged with the wheel 15 is drawn. Since the cable 9 is fixed by the cable fixing members 10 except for the portion of the cable 9 located between the sledges 6 and 6, the cable 9 fixed by the cable fixing members 10 in the direction in which the shearer is moved is progressively released from the cable fixing members 10 and drawn by the wheel 15 to move the shearer when the drawing force applied to the cable 9 by the wheel 15 becomes greater than the frictional resistance between the sledges 6, 7 and the conveyor 5. As described above, the cable 9 is released from the cable fixing members 10 only between the sledges 6 and 6 according to the present invention, so that tension is applied only to the cable 9 located between the sledges 6 and 6 when the wheel 15 is rotated.

The apparatus of the present invention having such construction and function as described above enables the length of the cable, which is to be tensioned, to be much shorter than in the conventional methods, thus eliminating the above-mentioned drawbacks and causing no problem even when plural shearers are drawn at a time by a common cable.

What is claimed is:

1. Apparatus for drawing shearers along a long-walled pit face of a coal mine comprising a conveyor arranged along the pit face of the coal mine, a shearer mounted to move along said conveyor, cable fixing means arranged along the conveyor, a cable means disposed along said cable fixing means, said cable means being engageable by said cable fixing means to preclude relative longitudinal movement between the cable means and the cable fixing means, driving means on said shearer engaging said cable means to drive said shearer along said conveyor, and guide wheel means on said shearers and engaging said cable means, said guide wheel means guiding the cable means between said driving means and said cable fixing means such that said cable means has an operational cable portion which extends between the cable fixing means and the driving means, whereby when the shearer drawing force is applied by said driving means to said cable means such drawing force is applied only to said operational cable portion.

2. Apparatus according to claim 1, wherein said cable fixing means, said drive means, and said guide wheel means are arranged such that the axial centerline of said cable means is always disposed in a single, generally vertical plane.

3. Apparatus according to claim 1, further comprising second guide wheel means mounted on said shearer to engage said operational portion of said cable means as the latter passes between the first said guide wheel means and said driving means.

4. Apparatus according to claim 1, further comprising sledge means movably mounting said shearer on said conveyor, said sledge means having a transverse projection projecting transversely of the direction of movement of the shearer, said projection overlying said cable fixing means to define a passageway between said projection and the underlying cable fixing means, said cable means passing through said passageway, said guide wheel means being disposed adjacent to said passageway to guide said cable means as the latter transverses between said cable fixing means and said driving means.

5. Apparatus according to claim 5, wherein said guide wheel means are rotatably mounted on said projections.

6. Apparatus according to claim 4, wherein said projection serve to hold said cable means in said cable fixing means.

7. Apparatus according to claim 6, wherein there are two of said projections each having a guide wheel means mounted thereon, said guide wheel means being spaced from one another considered along the path of travel of the shearer, said driving means being disposed between said two spaced guide wheel means, said cable means extending between said driving means and said passageway being under tension of said drawing force as the shearer is moved by said driving means while the remainder of the cable means is free of tension from said drawing force.

8. An apparatus according to claim 4, further comprising a guide member disposed along said conveyor for guiding the shearer as the latter moves along the conveyor, said cable fixing means being interposed between said guide member and said sledge, said transverse projections extending over said guide member and engaging said guide member to thereby guide said shearer along said conveyor.

9. An apparatus according to claim 4, wherein said cable means is a chain having concave-convex portions.

10. An apparatus according to claim 9, wherein said cable fixing means comprises spaced members having a configuration corresponding to that of the chain.

* * * * *